US009156175B2

(12) United States Patent
Wain

(10) Patent No.: US 9,156,175 B2
(45) Date of Patent: Oct. 13, 2015

(54) FLUID APPLICATOR FOR A PERSONAL-CARE APPLIANCE

(75) Inventor: Kevin James Wain, Reading (GB)

(73) Assignee: The Gillette Company, Boston, MA (US)

( * ) Notice: Subject to any disclaimer, the term of this patent is extended or adjusted under 35 U.S.C. 154(b) by 333 days.

(21) Appl. No.: 13/586,066

(22) Filed: Aug. 15, 2012

(65) Prior Publication Data

US 2013/0145623 A1 Jun. 13, 2013

Related U.S. Application Data

(60) Provisional application No. 61/568,877, filed on Dec. 9, 2011.

(51) Int. Cl.
*B26B 21/52* (2006.01)
*B26B 21/44* (2006.01)

(52) U.S. Cl.
CPC ..... *B26B 21/446* (2013.01); *B26B 21/521* (2013.01)

(58) Field of Classification Search
USPC ..... 30/41, 41.5, 34.05, 526, 50
See application file for complete search history.

(56) References Cited

U.S. PATENT DOCUMENTS

| | | | | |
|---|---|---|---|---|
| 3,032,803 | A * | 5/1962 | Walshauser | 401/190 |
| 3,252,217 | A | 5/1966 | Werft | |
| 3,417,468 | A | 12/1968 | Miyauchi | |
| 3,749,290 | A * | 7/1973 | Micallef | 222/207 |
| 3,822,720 | A | 7/1974 | Souza | |
| 4,077,119 | A * | 3/1978 | Sellera | 30/41 |
| 4,129,942 | A | 12/1978 | Denizman | |
| 4,177,556 | A * | 12/1979 | Galli, Jr. | 30/41 |
| 4,205,441 | A * | 6/1980 | Turner | 30/41.5 |
| 4,215,689 | A | 8/1980 | Akiyama et al. | |
| 4,314,404 | A * | 2/1982 | Ruiz et al. | 30/41 |
| 4,760,642 | A * | 8/1988 | Kwak | 30/123 |
| 4,809,432 | A * | 3/1989 | Schauble | 30/41 |
| 4,888,868 | A * | 12/1989 | Pritchard | 30/41 |
| 5,014,427 | A | 5/1991 | Byrne | |
| 5,022,154 | A | 6/1991 | Johnson | |
| 5,072,512 | A | 12/1991 | Noujain | |
| 5,092,041 | A | 3/1992 | Podolsky | |
| 5,103,560 | A | 4/1992 | Podolsky | |
| 5,134,775 | A | 8/1992 | Althaus et al. | |
| 5,168,628 | A * | 12/1992 | Mock et al. | 30/41 |

(Continued)

FOREIGN PATENT DOCUMENTS

| | | |
|---|---|---|
| DE | 434493 | 9/1926 |
| DE | 3305898 A1 | 8/1984 |

(Continued)

OTHER PUBLICATIONS

PCT International Search Report with Written Opinion in corresponding Int'l appln. PCT/US2012/068338 dated Mar. 13, 2013.

*Primary Examiner* — Sean Michalski
(74) *Attorney, Agent, or Firm* — Ronald Terk Sia; Kevin C. Johnson; Steven W. Miller

(57) ABSTRACT

A fluid dispensing cartridge for a personal care appliance with a fluid applicator having a baffle with a rear wall and an opposing resilient front flap. The baffle defines at least one outlet port. The resilient front flap contacts a portion of the rear wall in a first position and is spaced apart from the portion in a second position.

13 Claims, 6 Drawing Sheets

(56) References Cited

U.S. PATENT DOCUMENTS

| | | | | |
|---|---|---|---|---|
| 5,283,952 | A | 2/1994 | Mock et al. | |
| 5,316,452 | A | 5/1994 | Bogen et al. | |
| 5,337,478 | A | 8/1994 | Cohen et al. | |
| 5,402,573 | A | 4/1995 | Laniado | |
| 5,402,697 | A * | 4/1995 | Brooks | 83/18 |
| 5,638,601 | A | 6/1997 | Mol et al. | |
| 5,645,114 | A | 7/1997 | Bogen et al. | |
| 5,725,483 | A | 3/1998 | Podolsky | |
| 5,855,066 | A | 1/1999 | Manger | |
| 5,983,500 | A | 11/1999 | da Silva | |
| 5,993,180 | A * | 11/1999 | Westerhof et al. | 417/571 |
| 6,126,669 | A | 10/2000 | Rijken et al. | |
| 6,131,288 | A * | 10/2000 | Westerhof et al. | 30/41 |
| D437,661 | S | 2/2001 | Pinchuk | |
| 6,308,413 | B1 | 10/2001 | Westerhof et al. | |
| 6,312,436 | B1 | 11/2001 | Rijken et al. | |
| 6,493,940 | B2 | 12/2002 | Westerhof et al. | |
| 6,554,589 | B2 | 4/2003 | Grapes | |
| 6,665,937 | B2 | 12/2003 | Fürst et al. | |
| 6,754,958 | B2 * | 6/2004 | Haws et al. | 30/41 |
| 6,789,321 | B2 * | 9/2004 | Simms | 30/41 |
| RE38,634 | E | 10/2004 | Westerhof et al. | |
| 6,851,190 | B2 | 2/2005 | Guimont et al. | |
| 6,871,679 | B2 | 3/2005 | Last | |
| 6,886,254 | B1 | 5/2005 | Pennella | |
| 6,910,274 | B1 * | 6/2005 | Pennella et al. | 30/41 |
| 6,913,606 | B2 | 7/2005 | Saitou et al. | |
| 6,925,716 | B2 | 8/2005 | Bressler et al. | |
| 6,964,097 | B2 | 11/2005 | Franzini et al. | |
| 6,986,207 | B2 | 1/2006 | Selek | |
| 7,007,389 | B1 | 3/2006 | Arif | |
| 7,021,195 | B2 | 4/2006 | Proust | |
| 7,043,841 | B2 | 5/2006 | Franzini et al. | |
| 7,051,439 | B2 | 5/2006 | Tomassetti | |
| 7,103,977 | B2 * | 9/2006 | Guimont | 30/41 |
| 7,107,684 | B2 | 9/2006 | Steele et al. | |
| 7,121,754 | B2 | 10/2006 | Bressler et al. | |
| 7,137,203 | B2 | 11/2006 | Bressler et al. | |
| 7,155,828 | B2 | 1/2007 | Guimont et al. | |
| 7,234,239 | B2 | 6/2007 | Saito et al. | |
| D567,442 | S | 4/2008 | McMullan | |
| 7,402,165 | B2 | 7/2008 | Saitou et al. | |
| 7,651,010 | B2 | 1/2010 | Orzech et al. | |
| 7,686,675 | B2 | 3/2010 | Steele | |
| 7,752,757 | B2 | 7/2010 | Salvatore, Jr. | |
| 7,788,809 | B2 | 9/2010 | Tomassetti | |
| 7,788,810 | B2 * | 9/2010 | Noble | 30/41.5 |
| 7,814,661 | B2 | 10/2010 | Tomassetti | |
| 8,707,561 | B1 * | 4/2014 | Kneier | 30/34.2 |
| 8,782,904 | B2 * | 7/2014 | Wain | 30/41 |
| 8,826,543 | B2 * | 9/2014 | Szczepanowski et al. | 30/41 |
| 2003/0196328 | A1 | 10/2003 | Andino et al. | |
| 2004/0177510 | A1 | 9/2004 | Pennella | |
| 2004/0177519 | A1 | 9/2004 | Tomassetti et al. | |
| 2004/0191128 | A1 | 9/2004 | Bogen et al. | |
| 2004/0255465 | A1 | 12/2004 | Pennella et al. | |
| 2005/0120560 | A1 * | 6/2005 | Franzini et al. | 30/41 |
| 2005/0123342 | A1 * | 6/2005 | Bressler et al. | 401/263 |
| 2005/0144786 | A1 | 7/2005 | Bressler et al. | |
| 2005/0260090 | A1 | 11/2005 | Stark et al. | |
| 2006/0117582 | A1 * | 6/2006 | Al-Aula | 30/410 |
| 2006/0150386 | A1 * | 7/2006 | Wanli et al. | 29/449 |
| 2006/0240380 | A1 | 10/2006 | Chenvainu et al. | |
| 2006/0272154 | A1 * | 12/2006 | Brevard | 30/41 |
| 2007/0214646 | A1 * | 9/2007 | Bezdek | 30/41 |
| 2008/0216322 | A1 | 9/2008 | Molema et al. | |
| 2008/0307653 | A1 * | 12/2008 | Wattam | 30/41 |
| 2008/0307660 | A1 * | 12/2008 | Clarke | 30/535 |
| 2009/0183371 | A1 | 7/2009 | Mileti et al. | |
| 2009/0211099 | A1 * | 8/2009 | Louis | 30/41 |
| 2009/0263176 | A1 | 10/2009 | Mileti et al. | |
| 2009/0318883 | A1 * | 12/2009 | Sugahara et al. | 604/298 |
| 2010/0040489 | A1 | 2/2010 | Rosenzweig et al. | |
| 2010/0107415 | A1 | 5/2010 | Kurzet | |
| 2010/0115774 | A1 * | 5/2010 | De Klerk | 30/41.5 |
| 2010/0236071 | A1 * | 9/2010 | Szczepanowski et al. | 30/41.5 |
| 2011/0126413 | A1 * | 6/2011 | Szczepanowski et al. | 30/41 |
| 2011/0146080 | A1 * | 6/2011 | Pauw | 30/41.5 |
| 2011/0219621 | A1 | 9/2011 | Royle et al. | |
| 2012/0023750 | A1 * | 2/2012 | Blatter et al. | 30/41 |
| 2012/0102746 | A1 | 5/2012 | Jessemey et al. | |
| 2012/0102747 | A1 | 5/2012 | Wain | |
| 2012/0102748 | A1 | 5/2012 | Wain | |
| 2012/0102761 | A1 | 5/2012 | Jessemey et al. | |
| 2012/0266466 | A1 * | 10/2012 | Pennella | 30/41 |
| 2012/0311863 | A1 * | 12/2012 | Bennik et al. | 30/41 |
| 2013/0000127 | A1 * | 1/2013 | Coresh | 30/41 |
| 2013/0145624 | A1 * | 6/2013 | Jessemey et al. | 30/41 |
| 2013/0145625 | A1 * | 6/2013 | Xu et al. | 30/41 |
| 2013/0205959 | A1 * | 8/2013 | Jones et al. | 83/22 |
| 2013/0219721 | A1 * | 8/2013 | Coleman et al. | 30/41 |
| 2013/0305537 | A1 * | 11/2013 | Svedman | 30/41 |
| 2013/0326881 | A1 * | 12/2013 | Blatter | 30/41 |

FOREIGN PATENT DOCUMENTS

| | | | |
|---|---|---|---|
| FR | 2 551 391 | A1 | 3/1985 |
| FR | 2 634 154 | | 1/1990 |
| FR | 2 683 759 | A1 | 5/1993 |
| FR | 2 703 403 | | 10/1994 |
| GB | 1386461 | | 3/1975 |
| JP | 9-24982 | | 1/1997 |
| WO | WO 82/02372 | | 7/1982 |
| WO | WO 87/02422 | | 4/1987 |
| WO | WO 2006/122368 | A1 | 11/2006 |
| WO | WO 2010/059652 | A1 | 5/2010 |
| WO | WO 2011/073858 | | 6/2011 |

* cited by examiner

FLUID APPLICATOR FOR A PERSONAL-CARE APPLIANCE

CROSS REFERENCE TO RELATED APPLICATIONS

This application claims the benefit of U.S. Provisional application No. 61/568,877, filed Dec. 9, 2011.

FIELD OF THE INVENTION

The present invention relates to personal-care appliances in general, and more particularly, to fluid dispensing shaving razors having a fluid applicator for dispersing fluid to a surface of the skin or hair.

BACKGROUND OF THE INVENTION

Skin care can be of particular importance in improving or enhancing the appearance of men and women. Various products and methods can be used to care for skin. For example, exfoliant scrubs, cleansers, and lotions are sometimes used to maintain healthy-looking skin. Exfoliant scrubs can be used to remove dead skin cells from the surface of the skin, which can give the skin an improved tone. Soaps and other cleansers can be used to remove dirt and excess oil from the skin, which can help prevent clogging of pores. Consequently, acne and other types of skin blemishes can be prevented in some cases. Lotions and various other topical ointments can also be used to deliver nutrients and/or moisturizers to the skin in an effort to improve the appearance and/or the health of the skin. Other types of cosmetic products (e.g., creams and lotions) or drug actives are sometimes used in an attempt to eliminate wrinkling and other signs of aging.

It is generally known that the process of shaving the skin may provide certain skin benefits such as exfoliation and hydration. In general, shaving razors of the wet shave type include a cartridge or blade unit with at least one blade with a cutting edge which is moved across the surface of the skin being shaved by means of a handle to which the cartridge is attached; however, razor assemblies may also include electric foil type shavers. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled (i.e., disposable razor). The connection of the cartridge to the handle provides a pivotal mounting of the cartridge with respect to the handle so that the cartridge angle adjusts to follow the contours of the surface being shaved. In such systems, the cartridge can be biased toward a rest position by the action of a spring-biased plunger (a cam follower) carried on the handle against a cam surface on the cartridge housing.

The shaving process typically includes the application of a shaving aid material (e.g., shaving cream) to the surface and the separate step of shaving the hair using a razor assembly. The shaving aid material oftentimes includes at least one suitable agent (e.g., a lubricating agent, a drag-reducing agent, a depilatory agent, etc.) that enhances the shaving process. Most consumers find this type of preparation to be rather inconvenient because of the need for multiple shaving products, e.g., a wet shaving razor and a skin preparation product, as well as the undesirable necessity for multiple application steps during the wet shaving process. Furthermore, this process can be messy and requires the consumer rinse their hands after applying the shave gel. This multi-step process also results in an overall extended shaving experience which most consumers do not prefer given typical morning hygiene routines. It may, however, be desirable sometimes to apply fluids of other kinds to the skin before, during, or after shaving. It has been found that especially in the case of males who shave facial hair, it is important to provide a shave preparation of some sort prior to shaving in order to adequately hydrate the coarser facial hairs to allow for an easier and closer shave.

In the past, there have been a number of wet shaving product configurations that include a system for conveying a shaving preparation during shaving, e.g. a lubricating fluid, from a reservoir incorporated in the razor structure in the form of a hollowed out razor handle or even an aerosol can that acts as a razor handle, to a dispensing location near the head of the razor. A number of more recent wet shaving razors have cartridges that are movably mounted, in particular pivotable, relative to the handle structures on which they are mounted either permanently, in the case of disposable safety razors intended to be discarded when the blade or blades have become dulled, or detachably to allow replacement of the blade unit on a reusable handle structure. Many of these types of razors that are capable of conveying a fluid to the skin surface are unfortunately plagued by a number of problems. For instance, the innerworkings of the razors are complicated and tend to be cost prohibitive from a large scale manufacturing standpoint. Additionally, there are safety and performance issues that are constantly experienced due to clogging of fluid outlet ports.

The hair removal process is known to cause certain irritations and discomfort for skin. Accordingly, desirable skin benefits may include soothing and moisturization. Soothing and moisturization are not typically achieved by a shaving razor by itself, but by a lotion or cream that is applied to the skin after shaving and after the shave gel has been removed from the skin. Regardless of whether the hair removal process is via a wet or dry shave, there is an ongoing need to provide certain personal care compositions to accompany or facilitate the hair removal process. Typically, the personal care composition is sold as a separate package.

SUMMARY OF THE INVENTION

In one aspect, the invention features, in general, a fluid dispensing cartridge for a personal care appliance with a fluid applicator having a baffle with a rear wall and an opposing resilient front flap. The baffle defines at least one outlet port. The resilient front flap contacts a portion of the rear wall in a first position and is spaced apart from the portion in a second position.

In another aspect, the invention features, in general, a fluid dispensing shaving razor having a handle and a cartridge housing mounted to the handle. The cartridge housing has at least one blade. A fluid reservoir is positioned within the handle. A pump assembly is positioned within the handle and is in fluid communication with the fluid reservoir. A fluid applicator is in fluid communication with the pump assembly. The fluid applicator has a guard mounted to the cartridge housing. A baffle is in front of the guard. The baffle has at least one outlet port and a resilient front flap covering the outlet port.

In another aspect, the invention features, in general, a fluid dispensing cartridge for a shaving razor having a fluid interconnector with one end configured for mechanical and fluid connection to a handle. A cartridge housing is mounted to an opposing end of the fluid interconnector. A fluid applicator is mounted to the cartridge housing. The fluid applicator has a baffle with a resilient front flap. The baffle defines at least one outlet port in fluid communication with the fluid interconnector. The resilient front flap covers the outlet port to control the release of fluid.

The details of one or more embodiments of the invention are set forth in the accompanying drawings and the description below. Other features and advantages of the invention will be apparent from the description and drawings, and from the claims.

DETAILED DESCRIPTION OF THE INVENTION

The present disclosure is not limited to wet shaving razors, or even razors in general. It is understood that certain aspects of the present disclosure may also be used for dry electric shaving razors that have one or more rotating or reciprocating blades or other personal care appliances (e.g., toothbrushes, depilatory applicators, epilators, or other beauty applicators). Furthermore, it is understood that certain aspects of the present disclosure may be used independently of applying a fluid.

Figure 1A:
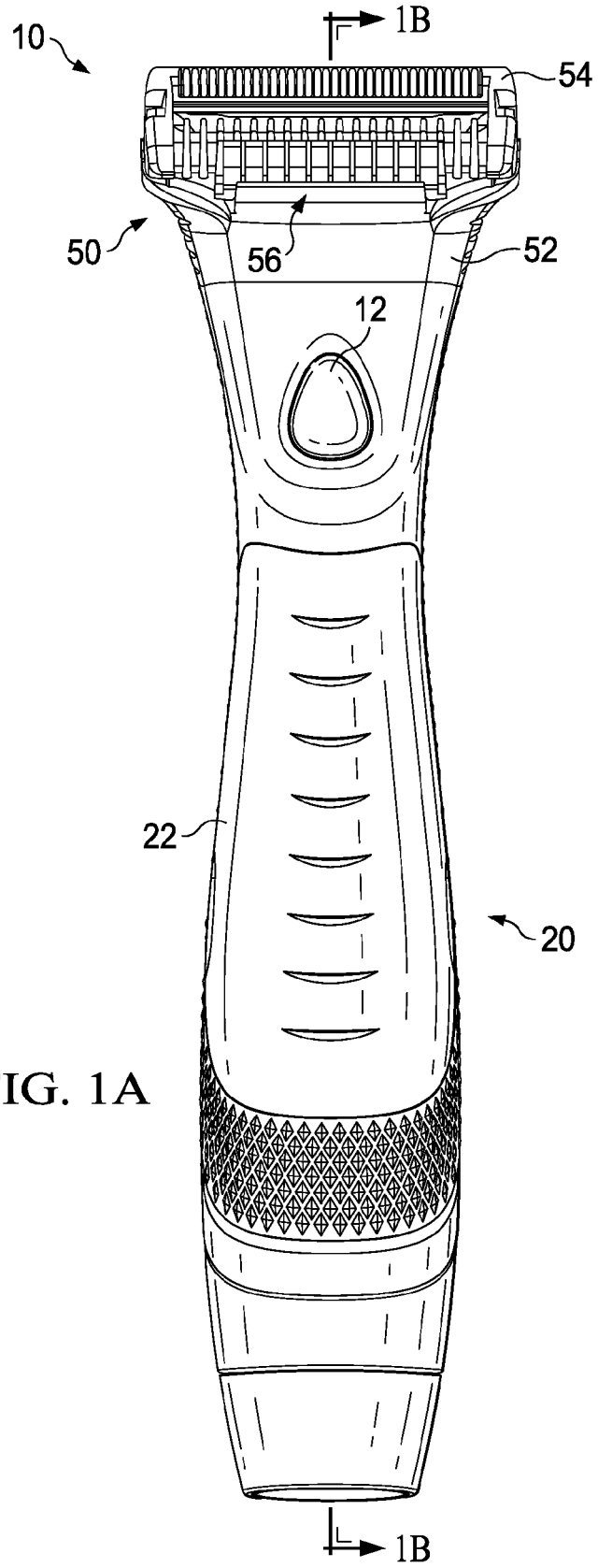
FIG. 1A is a front view of one possible embodiment of a personal-care appliance.

Referring to FIG. 1A, one possible embodiment of the present disclosure is shown illustrating a front view of a personal-care appliance 10. For example, the personal-care appliance may be a fluid dispensing razor (as shown), a toothbrush, a mascara brush, or any other personal-care appliance that dispenses a fluid. As will be described in greater detail below, the personal-care appliance 10 may include a handle 20 configured to receive a pump and a fluid reservoir (not shown). The handle 20 may have a cover 22 that protects and/or conceals the pump and/or fluid reservoir within the handle 20. A fluid dispensing cartridge 50 may be removably or fixedly mounted to the handle 20. The fluid dispensing cartridge 50 may have a fluid interconnector 52 at one end that makes a mechanical and fluid connection to the handle 20. A cartridge housing 54 may be pivotably mounted to the other end of the fluid interconnector 52. The fluid dispensing cartridge 50 may include a fluid applicator 56 to apply and/or spread the fluid to the surface to be treated (e.g., skin or hair) during a stroke of the personal-care appliance 10 against the skin. The personal-care appliance 10 may have an actuator 12 (e.g., a button) to facilitate pumping of the fluid from the fluid reservoir to the fluid applicator 56. In certain embodiments, the personal-care appliance 10 may include a non-removable fluid dispensing cartridge, depending on the desired final application of the personal care appliance.

Figure 1B:
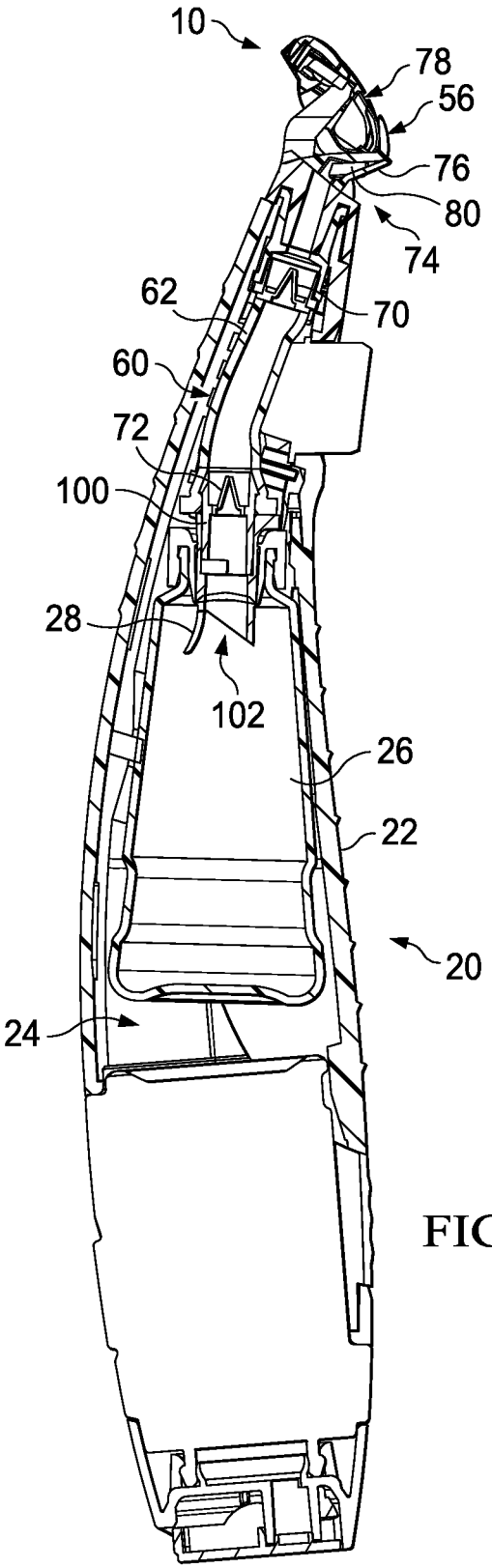
FIG. 1B is a cross section view of the personal-care appliance, taken generally along the line 1B-1B of FIG. 1A.

Referring to FIG. 1B a cross section view of the personal-care appliance 10, taken generally along the line 1B-1B of FIG. 1A is shown. A fluid (e.g., a lotion or gel) may be held within a fluid reservoir 26. The handle 20 may define a cavity 24 configured to receive the fluid reservoir 26. The personal-care appliance 10 of FIG. 1B is shown with the fluid reservoir 26 within the cavity 24 in a final loaded position with the cover 22 mounted and secured to the handle 20. In certain embodiments, the fluid reservoir 26 may be a delaminating bottle or a sachet. In other embodiments, the fluid reservoir 26 may be a blow molded or injection molded plastic bottle. A fluid connector 100 may removably engage the fluid reservoir 26 to establish fluid connection. An outer surface of the fluid connector 100 may seal against a wall of the fluid reservoir 26 to prevent fluid from leaking into the handle 20. The fluid connector 100 may pierce a seal 28 of the fluid reservoir 26 to establish a fluid connection between the fluid applicator 56 and the fluid reservoir 26. Accordingly, fluid is directed within an opening 102 of the fluid connector 100 which is in fluid communication with a pump assembly 60. The pump assembly 60 may include an elongated resilient tube 62 that pumps fluid from the fluid reservoir 26 through a pair of valves 70 and 72 (e.g., positioned within the elongated resilient tube 62) to the fluid applicator 56.

The actuator 12 (e.g., a button) may facilitate pumping of the fluid from the fluid reservoir 26 to the fluid applicator 56. For example, the actuator 12 may compress the resilient elastomeric tube 62 to open the first valve 70 and release a predetermined dosage of fluid to the fluid applicator 56. The fluid applicator 56 may include a baffle 74 with a resilient front flap 76 that is spaced apart from a rear wall 78 to define an elongated recess 80 that is configured to contain fluid released from the pump assembly 60. As will be explained in greater detail below, the resilient front flap 76 may open and close to control the release of fluid. The actuator 12 may be released to return the resilient elastomeric tube 62 to its uncompressed state. The first valve 70 may then close to prevent contamination and the second valve 72 may open to fill the resilient elastomeric tube 62 with fluid for the next release by the actuator 12. The actuator 12 may also facilitate pivoting of the fluid connector 100 for improved loading and unloading of the fluid reservoir 26.

Figure 2:
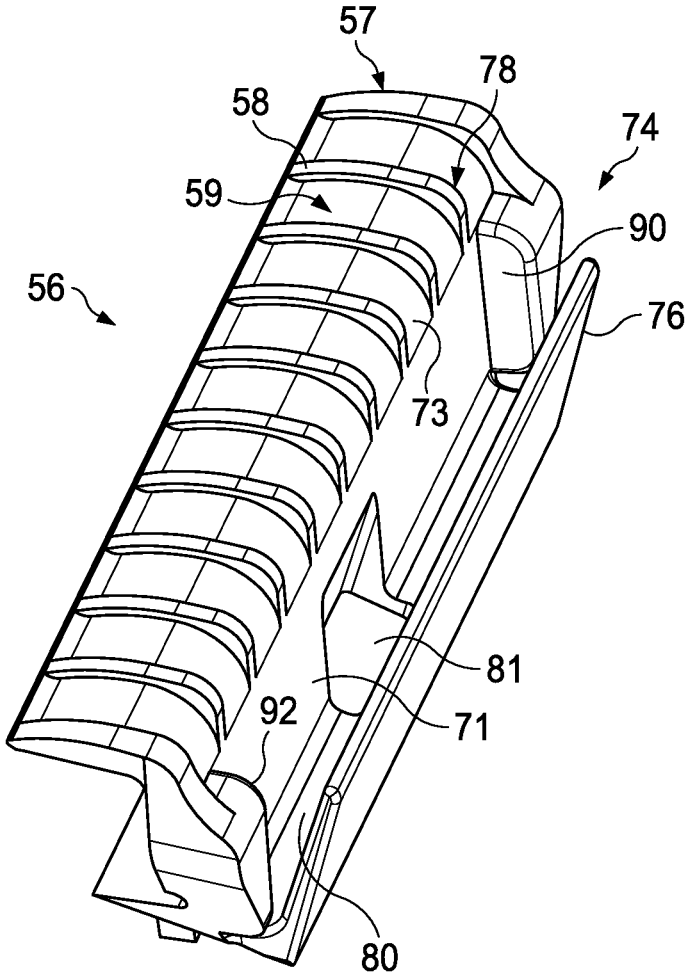
FIG. 2 is a perspective of one possible embodiment of a fluid applicator that may be incorporated into the personal-care appliance of FIG. 1A.

Referring to FIG. 2, a perspective view of the fluid applicator 56 is shown. The fluid applicator 56 may have a guard 57 with one or more projections 58 (e.g., ribs) that define one or more open channels 59. The projections 58 may prevent erratic glide of the fluid applicator 56 over the face during a shaving stroke. In addition, the projections 58 may decrease surface area in contact with skin and provide channels for fluid to flow onto the fluid applicator 56. The baffle 74 of the fluid applicator 56 may be located in front of the guard 57 for dispersing fluid onto the guard 57. In certain embodiments, the baffle may extend generally transverse to the guard 57 to prevent fluid from dripping out of the elongated recess 80 during use. The rear wall 78 of the baffle 74 may include a lower portion 71 and an upper portion 73. The resilient front flap 76 may be spaced apart from the rear wall 78 (e.g., the lower portion 71) to define the elongated recess 80. The baffle 74 may define an outlet port 81 positioned within the elongated recess 80. The outlet port may 78 extend into the lower portion 71 of the rear wall 78. The projections 58 and the channels 59 may extend from the guard 57 to the upper portion 73 of the rear wall 78. The channels 59 may facilitate the flow of fluid from the elongated recess 80 to the guard 57.

The elongated recess 80 of the baffle 74 may have a width (parallel to the blade edge) between a pair of end walls 90 and 92 of about 15 mm, 20 mm, or 25 mm to about 30 mm, 35 mm, or 40 mm (e.g., approximately the same width as the blade 22 and/or cartridge 12). The resilient front flap 76 may have a height of about 1 mm, 2 mm, or 3 mm to about 6 mm, 7 mm, or 8 mm. The baffle 74 may control the flow of fluid from the outlet port 81 to the guard 57 of the fluid applicator 56. For example, the front flap 76 may open and close to release fluid. The elongated recess 80 may be filled with fluid that is pumped from the fluid reservoir 26 (not shown) through the outlet port 81. The baffle 74 allows for a single and/or larger outlet port 81 to be used while still allowing maximum coverage of the guard 57 with fluid. Smaller ports may limit the viscosity of fluid that may be dispersed. In addition, smaller outlet ports may become clogged more often and difficult to clean. Furthermore, the consumer may flex the resilient font flap 76 away from the rear wall 78 to clean the elongated recess 80 before or after use.

The fluid applicator 56 may be molded from a thermoplastic elastomer such as TPE (thermoplastic elastomers). However, other resilient materials having a Shore A hardness (ISO 868) of about 20 to about 90 may be used including, but not limited to silicone, latex, polyvinylchloride (PVC), rubber, and polyurethanes. The applicator 56 may comprise a material having a tensile strength at break of about 8 $N/mm^2$, 9 $N/mm^2$, or 10 $N/mm^2$ to about 12 $N/mm^2$, 13 $N/mm^2$, or 14 $N/mm^2$ (ISO 37). The applicator 56 may comprise a material having a percent elongation at break of about 300% $mm^2$, 400%, or 500% to about 600% $mm^2$, 700%, or 800% (ISO 37). The hardness, tensile strength, and/or percent elongation of the fluid applicator 56 may provide the resilient front flap 76 of the baffle 74 with sufficient resiliency to flex and disperse the fluid. In certain embodiments, the resilient front flap 76 may have a thickness of about 0.3 mm, 0.4 mm, or 0.5 mm to about 0.6 mm, 0.8 mm, or 10 mm such that the resilient front flap 76 has sufficient resiliency for flexing and dispersing the fluid. The baffle 74 allows for the control and release of fluid during a shaving stroke. The elongated recess 80 allows the same volume of fluid to be dispersed with a single outlet port 81. Typically the same amount of volume would need to be dispersed by a plurality of smaller orifices (outlet ports). The smaller outlet ports may require a pump with more pressure and the outlet ports may become easily clogged with shaving debris. Smaller outlet ports also require lower viscosity fluid, which may limit the lotion or shaving prep that can be used with the hair removal device 10. In certain embodiments, the size of the outlet port 81 may be about 1 $mm^2$, 1.5 $mm^2$, or 2 $mm^2$ to about 4 $mm^2$, 6 $mm^2$, or 8 $mm^2$.

Figure 3:
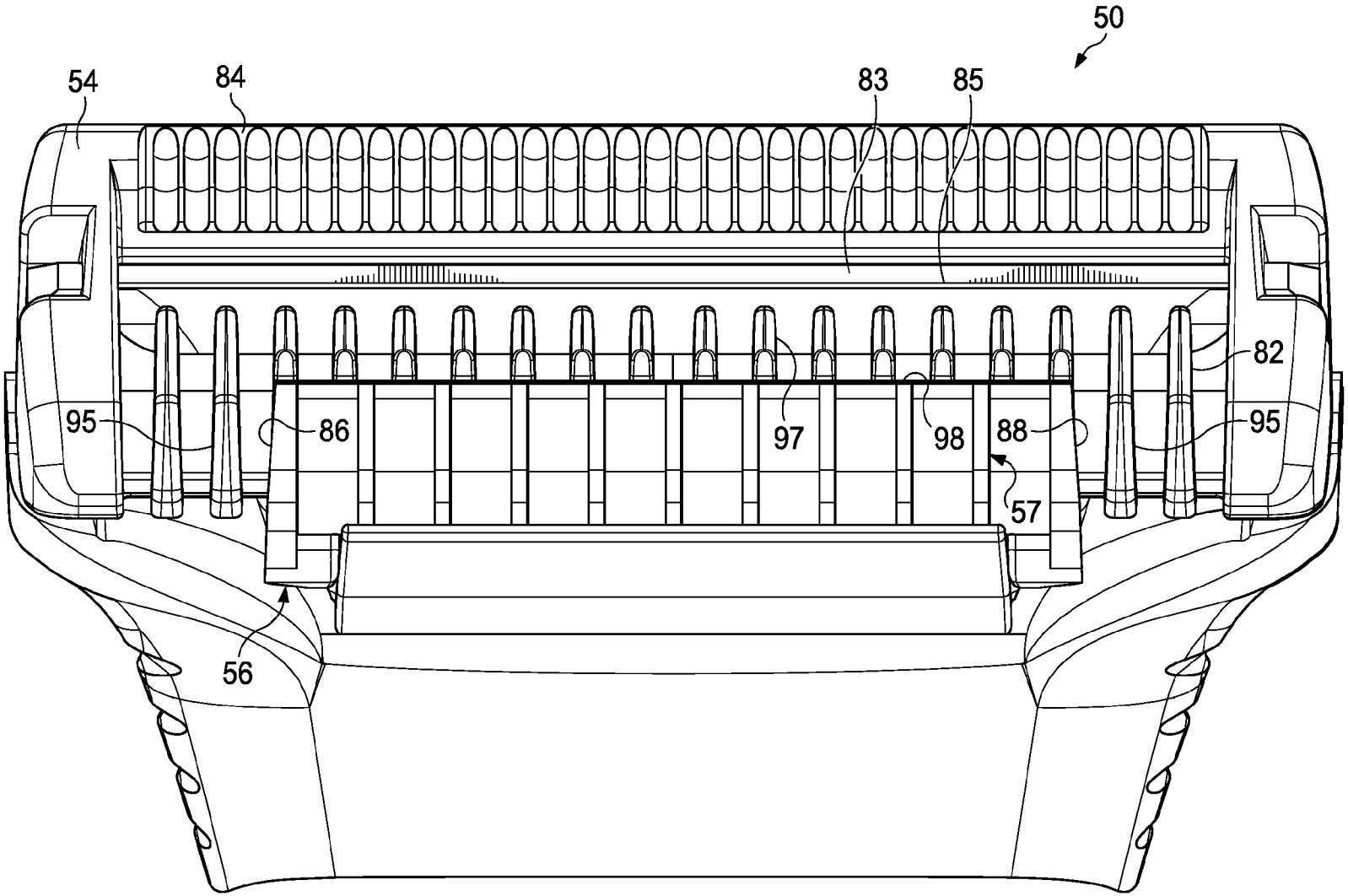
FIG. 3 is a front view of one possible embodiment of a fluid dispensing cartridge that may be incorporated into the personal-care appliance of FIG. 1A.

Referring to FIG. 3, a front view of the fluid dispensing cartridge 50 is shown. The cartridge housing 54 may include a guard 82 at a front of the cartridge housing 54, a cap 84 at a rear of the cartridge housing 54, and at least one blade 83 having a blade edge 85 between the cap 84 and the guard 82. The cartridge housing 54 may be injection molded from a semi-rigid polymeric material, such as high impact polystyrene. The cartridge housing 54 may be molded from other semi-rigid polymers having a Shore D hardness of about 60 to 140, including, but not limited to Noryl™ (a blend of polyphenylene oxide (PPO) and polystyrene developed by General Electric Plastics, now SABIC Innovative Plastics), acrylonitrile butadiene styrene (ABS), acetal, polypropylene, high impact polystyrene, or any combinations thereof. The blade 83 may be a cutting blade (e.g., for a shaving razor), a scraping blade (e.g., for a depilatory device), or a pulling blade (e.g., for an epilator). Although only one blade 83 is shown mounted to the cartridge housing 54, the cartridge housing 54 may have more blades 83 depending on the desired performance and cost of the fluid dispensing cartridge 50 and personal-care appliance 10. In certain embodiments, the blade 83 may be mounted to the cartridge housing 54 and secured by cold staking. Other assembly methods known to those skilled in the art may also be used to secure and/or mount the blade 83 to the cartridge housing 54 including, but not limited to, wire wrapping, clips, hot staking, insert molding, ultrasonic welding, and adhesives.

The fluid applicator 56 (e.g., guard 57) may be mounted to the guard 82 of the cartridge housing 54 (e.g., the cartridge housing 54 may support the fluid applicator 56). In certain embodiments, the fluid applicator 56 (e.g., guard 57) may positioned between a pair of protrusions 95 of the guard 82. For example, the protrusions 95 may be located on one or more sides 86 and 88 of the guard 57. The guard of the cartridge housing 54 may have one or more protrusions 97 at a leading edge 90 of the guard 57. The protrusions 95 and 97 may aid in retaining the fluid applicator 56 in the proper position during use (e.g., on the guard 82 of the cartridge housing 54). The protrusions 95 and 97 may extend transverse to the blade edge 85. In certain embodiments, the protrusions 97 in front of the fluid applicator 56 may be generally aligned (e.g., overlapping) with one or more of the projections 58 of the fluid applicator 56.

Figure 4:
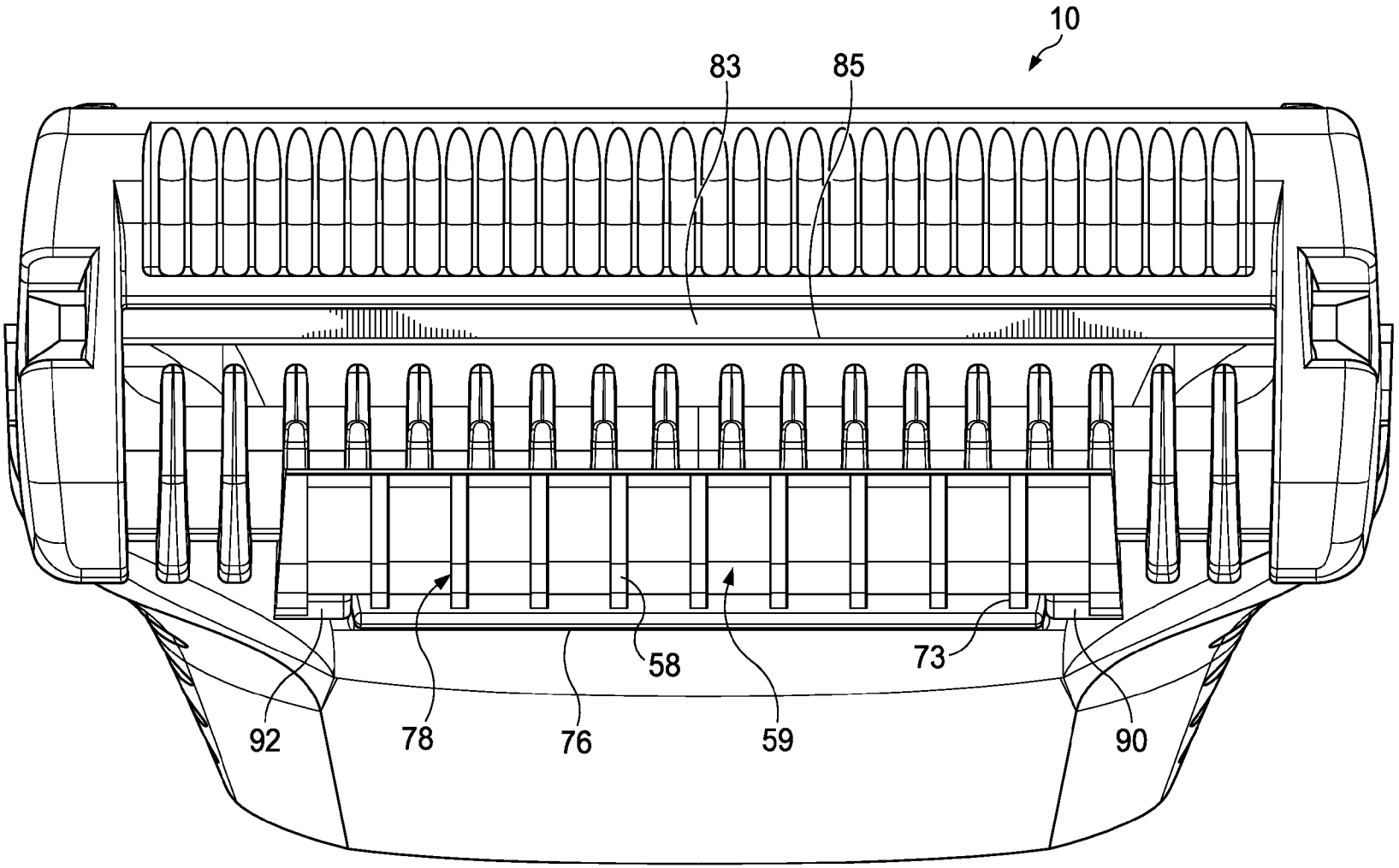
FIG. 4 is an enlarged front perspective view of the personal-care appliance of FIG. 1A in a first position.

Referring to FIG. 4, an enlarged view of the personal care-appliance 10 of FIG. 1A is shown in a first (e.g., neutral or closed) position. In the neutral position, the resilient front flap 76 may contact the upper portion 73 of the rear wall 78. The resilient front flap 76 may cover the outlet port 81 (not shown) to act as a valve for controlling the release of fluid. The end walls 90 and 92 may limit fluid from exiting the side of the elongated recess 80. The elongated recess 80 may extend parallel to the blade edge 85 of the blade 83 to facilitate the release of fluid across a substantial length of the blade edge 85 which may increase lubrication of the skin and/or hair in front of the blade edge 85 to decrease irritation. The projections 58 and the channels 59 of the fluid applicator 56 may extend generally transverse to the blade 83 (i.e., blade edge 85) to facilitate the flow of fluid toward the blade edge 85. The resilient front flap 76 may contact the projections 58 to limit fluid from exiting the cavity. The resilient front flap 76 may be spaced apart from the open channels 59 of the rear wall 78 to direct fluid into the open channels 59 along the elongated recess 80. For example, fluid may exit through the open channels 59 in the neutral position (e.g., depending on the viscosity of the fluid). The resilient front flap 76 may prevent excess fluid from being released from the fluid applicator 56 when the consumer is not activating the pump (e.g., compressing actuator 12).

Figure 5:
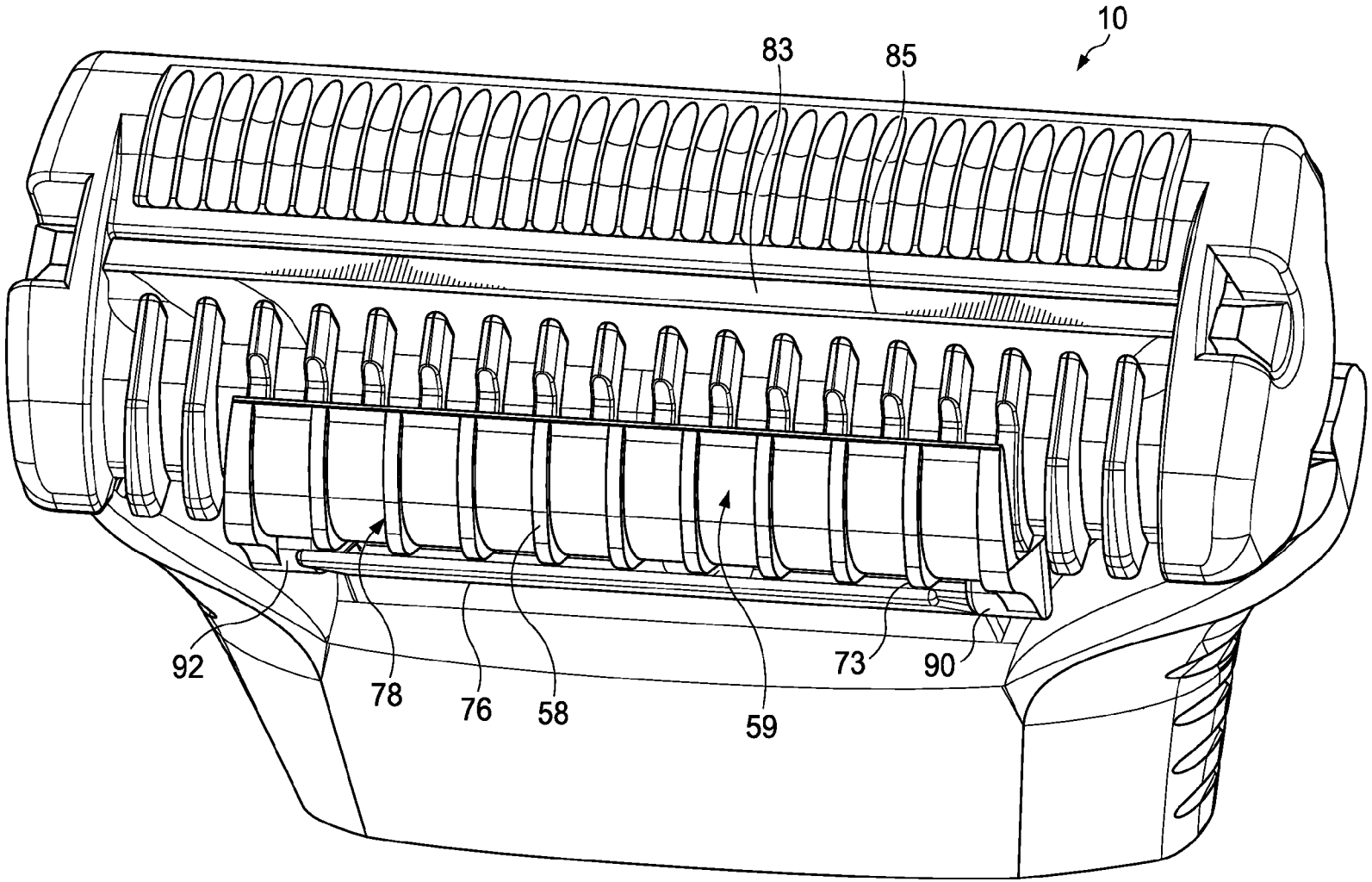
FIG. 5 is an enlarged front perspective view of the personal-care appliance of FIG. 1A in a second position.

As previously explained, the consumer may compress the elongated resilient tube 62 by pressing the actuator 12 (see FIG. 1B). Accordingly, the pump assembly 60 may fill the elongated recess 80 of the fluid applicator 56 with fluid from the fluid reservoir 26 (see FIG. 1B). Referring to FIG. 5, an enlarged view of the personal care-appliance 10 of FIG. 1A is shown in a second (e.g., open or activated) position. The resilient front flap 76 may be separable from the rear wall 78 for allowing the passage of fluid. For example, the filling of the elongated recess 80 may force the resilient front flap 76 forward and away from the rear wall 73. In the second position, the resilient front flap 76 may be spaced apart from one or more of the projections 58, facilitating increased dispersing of fluid to the guard 57 of the fluid applicator 56. Depending on the pressure and amount of fluid being pumped, the resilient front flap 76 may only be spaced apart (e.g., not directly contacting) from some of the projections 58.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fluid dispensing shaving razor cartridge comprising:

a cartridge housing having a guard, a cap, and at least one blade between the cap and the guard, the at least one blade having a cutting edge; and a fluid applicator comprising a baffle with a rear wall and an opposing resilient front flap, the baffle defining at least one outlet port, wherein the resilient front flap contacts a portion of the rear wall in a first position and is spaced apart from the portion of the rear wall in a second position and an applicator guard arranged behind the baffle and between the baffle and the blade, wherein the applicator guard comprises a plurality of ribs defining a plurality of open channels arranged transverse to the at least one blade.

2. The fluid dispensing cartridge for a personal care appliance of claim 1 wherein the portion of the rear wall comprises a plurality of spaced apart projections defining a plurality of channels extending transverse to the blade edge.

3. The fluid dispensing cartridge for a personal care appliance of claim 2 wherein the resilient front flap is spaced apart from the channels in the first and second positions.

4. The fluid dispensing cartridge for a personal care appliance of claim 1 wherein the front flap is spaced apart from a portion a rear wall of the baffle to define an elongated recess.

5. The fluid dispensing cartridge for a personal care appliance of claim 4 wherein the outlet port is located within the elongated recess.

6. The fluid dispensing cartridge for a personal care appliance of claim 1 wherein the resilient front flap is separable from the rear wall to allow the passage of fluid.

7. The fluid dispensing cartridge for a personal care appliance of claim 1 wherein the fluid applicator comprises a material having a Shore A hardness of about 20 to about 90.

8. The fluid dispensing cartridge for a personal care appliance of claim 1 wherein the resilient front flap has a thickness of about 0.3 mm to about 1.0 mm.

9. The fluid dispensing shaving razor cartridge of claim 1 further comprising a fluid interconnect member joined to the fluid applicator, wherein the fluid interconnect member and fluid applicator are in fluid communication.

10. The fluid dispensing shaving razor cartridge of claim 9 wherein the cartridge housing is pivotably mounted to the fluid interconnect member.

11. A fluid dispensing shaving razor cartridge comprising a cartridge housing having a guard, a cap, and at least one blade between the cap and the guard, the at least one blade having a cutting edge;

a fluid interconnector having one end configured for mechanical and fluid connection to a handle and an opposing end pivotably mounted to the cartridge housing; and a fluid applicator mounted to the cartridge housing, the fluid applicator having a baffle with a resilient front flap, the baffle defining at least one outlet port in fluid communication with the fluid interconnector, wherein the resilient front flap covers the outlet port to control the release of fluid and an applicator guard arranged behind the baffle and between the baffle and the blade, wherein the applicator guard comprises a plurality of ribs defining a plurality of open channels arranged transverse to the at least one blade.

12. The fluid dispensing shaving razor cartridge of claim 11 wherein the resilient front flap has a closed position and an open position wherein the resilient front flap contacts a rear wall of the baffle in the closed position and the resilient front flap is spaced apart from the rear wall of the baffle in the open position facilitating fluid to flow from the outlet port.

13. The fluid dispensing shaving razor cartridge of claim 12 wherein the resilient front flap has a thickness of about 0.3 mm to about 1.0 mm.

* * * * *